US006501327B1

(12) United States Patent
Tam

(10) Patent No.: US 6,501,327 B1
(45) Date of Patent: Dec. 31, 2002

(54) INPUT BIAS CURRENT REDUCTION CIRCUIT FOR MULTIPLE INPUT STAGES HAVING A COMMON INPUT

(75) Inventor: Kimo Tam, Lincoln, MA (US)

(73) Assignee: Analog Devices, Inc., Norwood, MA (US)

( * ) Notice: Subject to any disclaimer, the term of this patent is extended or adjusted under 35 U.S.C. 154(b) by 0 days.

(21) Appl. No.: 09/709,177

(22) Filed: Nov. 10, 2000

(51) Int. Cl.[7] ..... G05F 3/00
(52) U.S. Cl. ..... 327/538; 327/362
(58) Field of Search ..... 327/538, 362, 327/530; 323/315

(56) References Cited

U.S. PATENT DOCUMENTS 6,144,246 A * 11/2000 Wachter ..... 327/513
6,229,376 B1 * 5/2001 Geysen ..... 327/538

* cited by examiner

*Primary Examiner*—Terry D. Cunningham
(74) *Attorney, Agent, or Firm*—Iandiorio & Teska

(57) ABSTRACT

An input bias current reduction circuit for multiple input stages having a common input includes a plurality of input stages each including a first input transistor with its base connected to the common input and the first current sensing transistor with its collector-emitter in series with the collector-emitter of the first input transistor and its base current replicating that of the first transistor; and a current compensation circuit for sensing the base current of the first current sensing transistor in each input stage and subtracting that from the base current of the first input transistor in each input stage for maintaining constant reduced current loading of the input.

14 Claims, 4 Drawing Sheets

INPUT BIAS CURRENT REDUCTION CIRCUIT FOR MULTIPLE INPUT STAGES HAVING A COMMON INPUT

FIELD OF INVENTION

This invention relates to an input bias current reduction circuit for multiple input stages having a common input.

BACKGROUND OF INVENTION

Many circuits exhibit an undesirable nonzero input bias current which causes an offset voltage from the source voltage as it flows through the source impedance. A fixed offset voltage can often be compensated, but one that varies (e.g. with temperature or system configuration) is more troublesome. In a video system, the source impedance is typically 75Ω or 37.5Ω and offsets are perceived as variations in the video black level. It is desirable to reduce the input bias current, and the variation thereof, of a circuit having an input lead that is shared by a number (N) of input stages. Such a configuration can be found at each input of an (M input by N output) analog video cross point switch implemented using bipolar transistors. Each input stage on a given input line corresponds to an output to which that input signal may be routed; an input may be connected to anywhere from zero to N outputs via these input stages. In this case, the bias current of an input stage corresponds to the base current of a bipolar transistor, which is strongly dependent upon temperature and process variations. If the N input stages of the crosspoint are nominally identical, then the input bias current seen at the input lead can vary from nearly zero (in the case where that input is not routed to any of the outputs) to N times greater than that of any input stages (in the broadcast mode where that input is routed to all of the outputs).

A video crosspoint switch typically has a plurality of input stages arranged in rows and columns. All of the input stages in a column are connected to a common input and any one or more of them may be receiving an input at any time. Each input stage includes an input transistor whose base to emitter leakage current loads the common input and causes variations in the input current which fluctuates with the number of input stages in that column that are on. The base to emitter leakage current introduces errors in the response of the input stage; and the fluctuation of the error with the number of input stages that are on compounds the problem. One solution has been to add a buffer stage in each common input to each column so that no matter what the total current leakage or how it varies the voltage of the input signal will remain constant. However, the provision of this buffer adds area, transistors, power, noise and distortion. In another approach each stage has added to it a replication circuit which senses the leakage current in that stage and adds that current back to offset the error in that stage. This approach adds significant area to each stage and is multiplied by the number of stages.

SUMMARY OF THE INVENTION

It is therefore an object of this invention to provide an improved input bias current reduction circuit for multiple input stages having a common input.

It is a further object of this invention to provide such an improved input bias current reduction circuit which is simple, small, and easy to implement.

It is a further object of this invention to provide an improved input bias current reduction circuit which does not significantly add to the area, power or transistors required or to noise and distortion.

It is a further object of this invention to provide an improved input biased current reduction circuit which can also serve to provide a conventional voltage bias to each input stage.

The invention results from the realization that a more precise compensation for input bias leakage current in multiple input stages with a common input can be achieved by measuring the leakage current in each input stage connected to the common input and then replicating the current for all the input stages connected to the same common input and subtracting that current from the input.

This invention features an input bias current reduction circuit for multiple input stages having a common input. There are a plurality of input stages each including a first input transistor with its base connected to the common input and the first current sensing transistor with its collected-emitter in series with the collector-emitter of the first input transistor and its base current replicating that of the first transistor. A current compensation circuit senses the base current of the first current sensing transistor in each input stage and subtracts that from the base current of the first input transistor in each input stage for maintaining constant reduced current loading of the input.

In a preferred embodiment each input stage may include a second input transistor. The first current sensing transistor may be cascode connected to the first input transistor. The first current sensing transistor may be cascode connected to the first input transistor and there may be a second current sensing transistor cascode connected to the second input transistor. The first and the second input transistors may be emitter coupled and they may form a differential amplifier. The bases of the first and second current sensing transistors may be connected together. The transistors may be bipolar. The current compensation circuit may include a current mirror and it may include an idle current source. The current compensation circuit may be connected to a voltage source and may provide a bias voltage to the current sensing transistors. The first input transistor may be common emitter connected.

BRIEF DESCRIPTION OF THE DRAWINGS

Other objects, features and advantages will occur to those skilled in the art from the following description of a preferred embodiment and the accompanying drawings, in which.

PREFERRED EMBODIMENT

Figure 1:
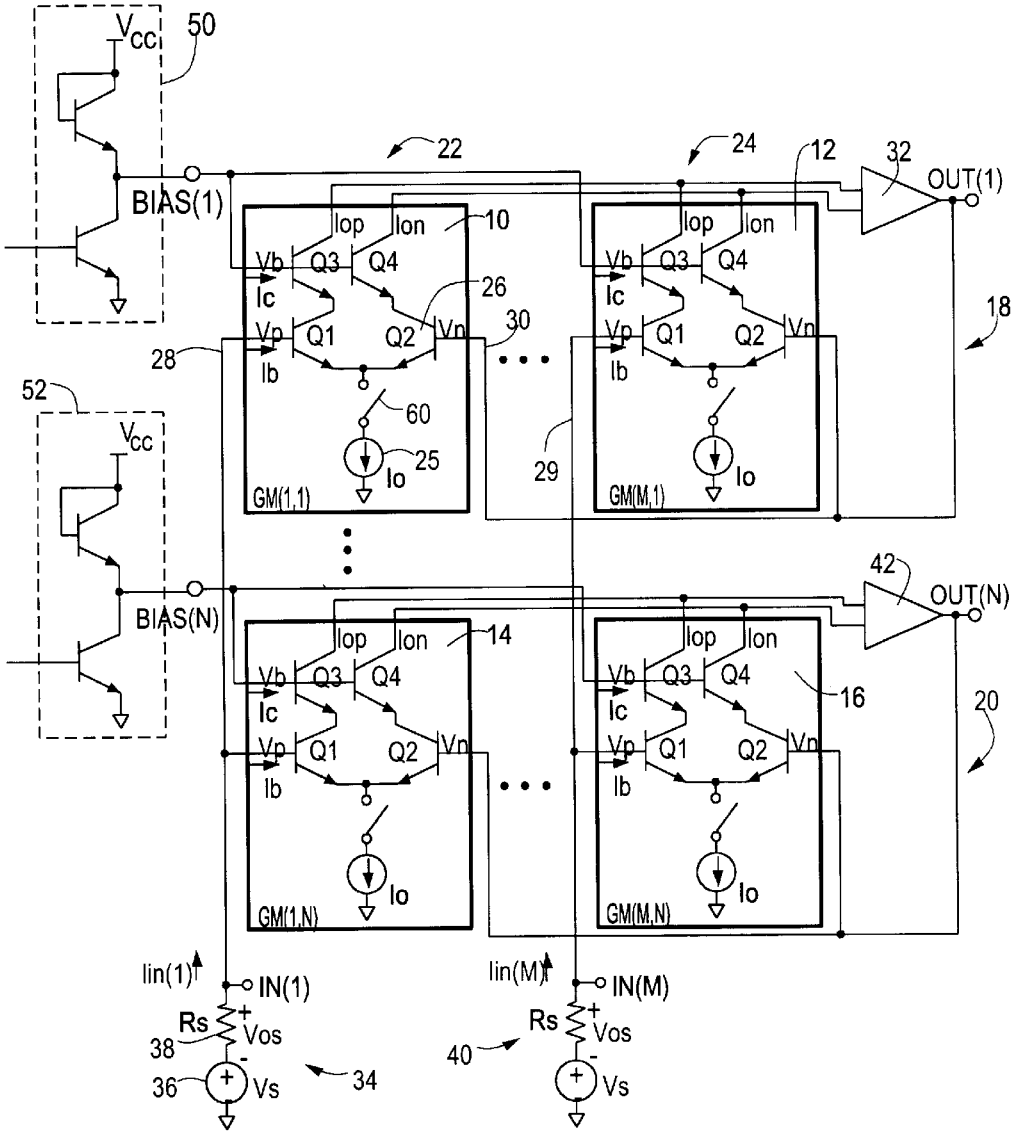
FIG. 1 PRIOR ART
FIG. 1 is a schematic diagram of a portion of a video cross point switch with a prior art input bias current circuit for multiple stages with a common input.
Figure 2:
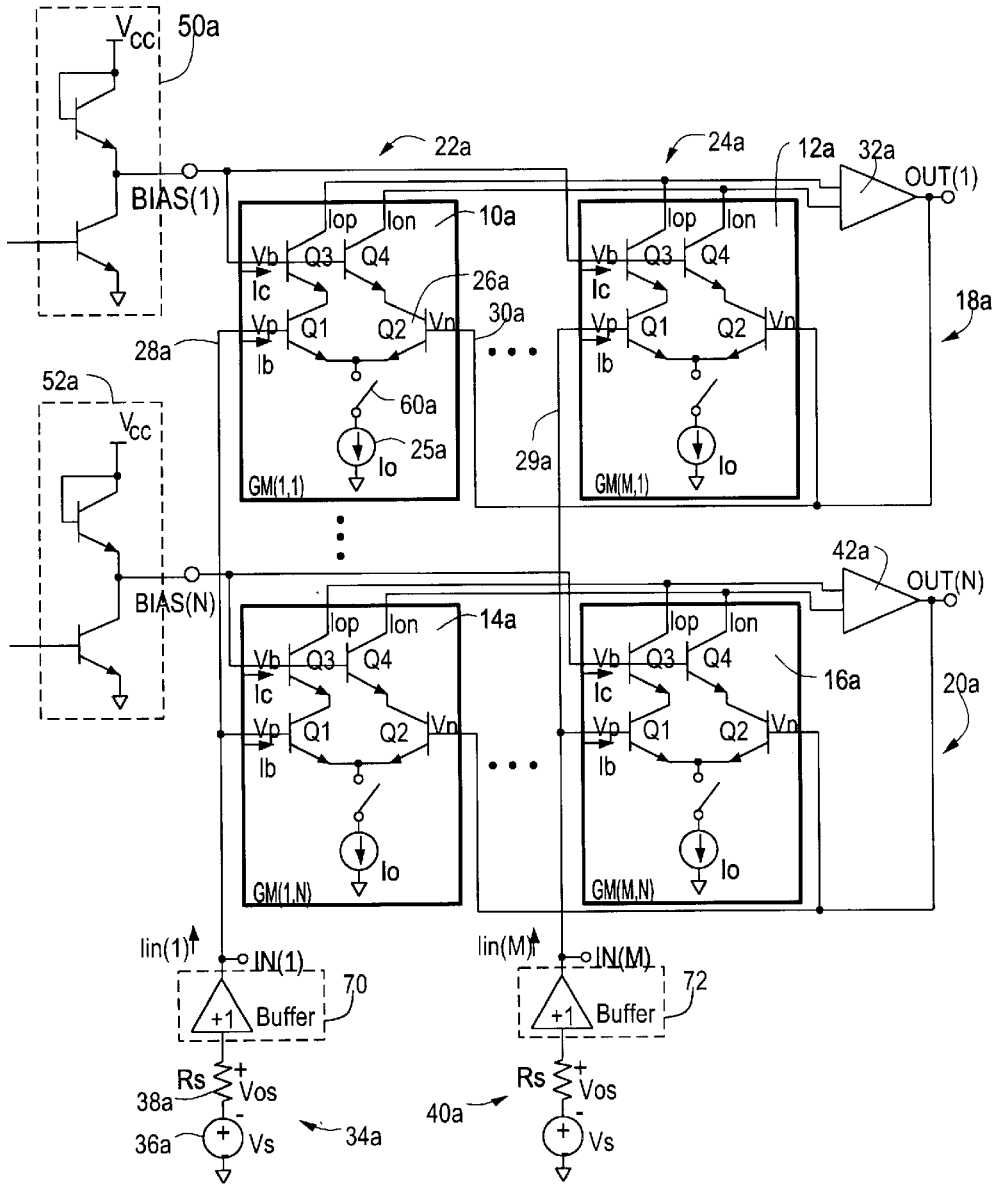
FIG. 2 PRIOR ART
FIG. 2 is a schematic diagram of a portion of a video cross point switch with a prior art input bias current circuit for multiple stages with a common input with a buffer amplifier added to maintain voltage.

There is shown in FIG. 1 is a plurality of input stages 10, 12, 14, 16, arranged in a matrix of rows 18, 20 and columns 22 and 24 in the implementation of a video cross-point switch for example. Each stage includes a pair of bipolar transistors $Q_1$ and $Q_2$ connected to a common emitter connection forming a differential amplifier 26 which has two inputs $V_p$ 28 and $V_n$ 30. Current sensing output transistors $Q_3$ and $Q_4$ are connected in cascode with transistors $Q_1$ and $Q_2$ and have their bases connected together to bias voltage $V_b$. Their collectors provide the outputs $I_{op}$ and $I_{on}$ to output amplifier 32. All of the input stages 10–14 in column 22 have their inputs $V_p$ connected to a common input source 34 which includes a voltage source 36 and a resistance 38 which represents the onchip conductor resistance and/or the terminating resistance from a video line, for example. Each column 22 and 24 has its own voltage source so that column 24 includes a voltage source 40 similar to voltage source 34 which is connected to common input 29. Each row has its own output amplifier 42 which responds to the outputs $I_{op}$ and $I_{on}$ from each of the input stages in that row. For example, in row 18, output amplifier 32 responds to the $I_{op}$ and $I_{on}$ output of input stage 10 and input stage 12 whereas in row 20 output amplifier 42 responds to the outputs $I_{op}$ and $I_{on}$ of output stages 14 and 16. The bias $V_b$ at each input stage is separately provided to the input stages of each row thus row 18 receives the bias input $V_b$ for each of its input stages 10 and 12 from bias circuit 50 while the $V_b$ bias for input stages 14 and 16 of row 20 is provided by circuit 52. Each of the bias circuits 50 and 52 includes at least a pair of transistors.

In operation, the second input at each input stage, input 30, $V_n$, at input stage 10, is a feedback signal from the output associated with the row in which the stage is located. Thus, the input 30, Vn to stage 10 is derived from the output from amplifier 32 while the input $V_n$ in stages 14 and 16 is fed back from the output of amplifier 42.

In operation, the enabling switch (60) of one or more of the input stages in each column may be closed at any time. For example, column 22, stage 10 may be on or 10 and 14 may be on or just 14 may be on. Whether the stage is on or off, is indicated by the position of switch 60 at current source 25 in input stage 10 for example. Assuming that there is an input signal present on the common input line 28, the signal appears as the voltage $V_p$ at the base of transistor $Q_1$ in input stage 10. With switch 60 closed, the current $I_o$ is drawn which turns on differential amplifier 26 and, as a side effect, causes input bias current $I_b$ to flow. This current flows through source resistance 38 and causes a voltage error $V_{os}$ between the true source voltage 36 and that seen by amplifier 26. Therefore the output of differential amplifier 26 and the cascode-converted $Q_3$ and $Q_4$ is not truly representative of the input voltage $V_p$. The base to emitter current $I_b$ may indeed be quite a small current but it causes a difficult problem for two reasons. First, the number of input stages, while here shown only as four is more normally in the tens, hundreds, even thousands of stages. A small leakage current $I_b$ in the order of a micro amp can thus be multiplied greatly and introduce a substantial error. Second, the total leakage current that flows will be a function of the number of the stages which are on which varies from moment to moment and cannot be relied upon.

In one prior art solution to this problem, the buffer 70, 72 is added in each common input line so that regardless of the amount of leakage current $I_b$ that is drawn from the stages 10 and 14 and the others in that column, or from stages 12 and 16 and the others in column 24, the output voltage will remain constant so that the common input signal $V_b$ will be unaffected. One of the problems with this solution is that the buffer introduces its own noise and distortion problems and takes up substantial area, power, and transistors.

Figure 3:
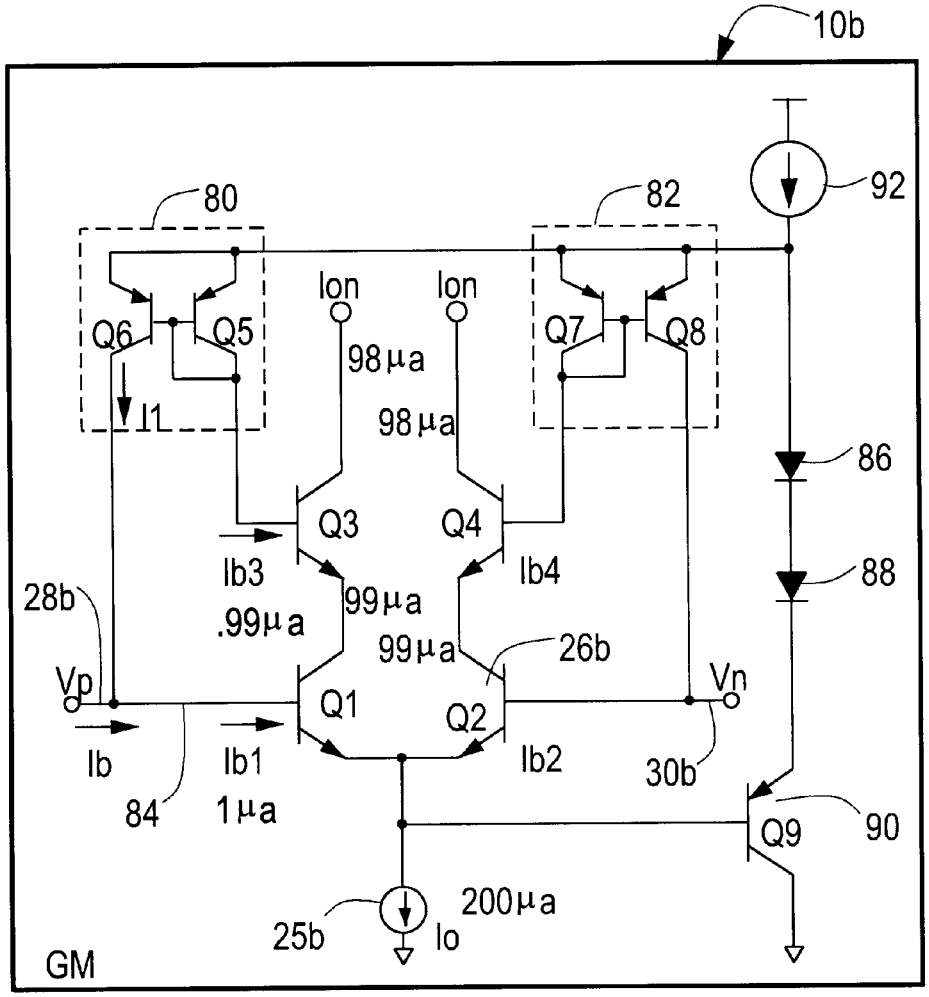
FIG. 3 PRIOR ART
FIG. 3 is a schematic diagram of a portion of a video cross point switch with a prior art input bias current circuit for multiple stages with a common input with a compensating circuit included in every stage.

In another prior art approach, a current mirror 80, 82, FIG. 3, is added to provide a replicating current. For example, with $Q_1$ drawing a base to emitter leakage current of $I_{b1}$ and $Q_3$ drawing a leakage current of $I_{b3}$ the values of the two currents are made essentially equal. For example, if $I_{b1}$ is 1 micro amp, then $I_{b3}$ would be approximately 0.99 micro amps. The current mirror 80 replicates the current $I_{b3}$ and reverses it, or subtracts it, from the current and provides it as current $I_1$ back to the input line 84 to the base of transistor $Q_1$. This nearly exactly compensates for the base to emitter leakage current $I_{b1}$ and eliminates the error. Current mirror 82 works in the same way with respect to currents $I_{b4}$ and $I_{b2}$. Diodes 86 and 88 in conjunction with transistor 90 and current source 92 set the bias for current mirrors 80 and 82. As can be seen, this approach adds five transistors and two diodes and more importantly, assumes a much greater area on the chip when this area is multiplied by the tens, hundreds, and even thousands of stages which may be used. The size of the chip can quickly become prohibitively large.

Figure 4:
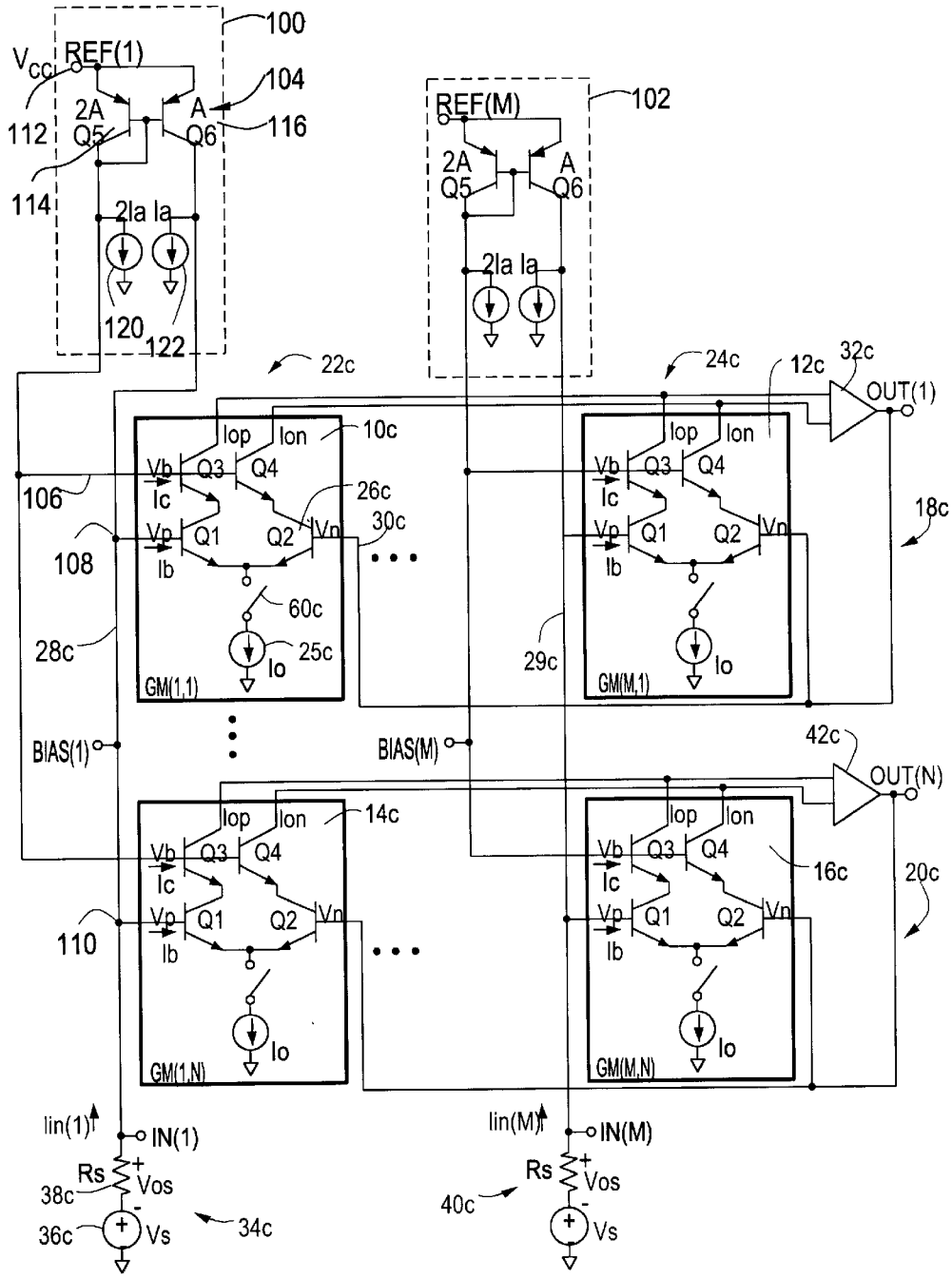
FIG. 4 is a schematic diagram of a portion of a video cross point switch using an input bias reduction current circuit for multiple input stages having a common input according to this invention.

In accordance with this invention, a current compensation circuit 100, 102, FIG. 4, is associated with each column 22, 24 of input stages, thus there is only one compensation circuit for each column of input stages rather than one for each input stage. The current compensation circuits as explained with respect to circuit 100 include a current mirror 104 which senses the current on line 106 from the bases of transistors $Q_3$ and $Q_4$, replicates that current, and then provides a replicated compensation current back at 108 to compensate for the leakage current $I_b$ to transistor $Q_1$ in stage 10 and also provides the compensated current at 110 to the base of transistor $Q_1$ to compensate for the base to emitter leakage current $I_b$ in stage 14. As before, transistors $Q_3$ and $Q_4$ are cascode connected to transistors $Q_1$ and $Q_2$ and all of them may be bipolar transistors. The bases of transistors $Q_3$ and $Q_4$ are also again connected together. In accordance with this invention, the current mirror 104 adds little more than the original bias circuits 50, 52 in the prior art but provides the current compensation as well as the voltage bias $V_b$ since the reference terminal 112 of current mirror 104 is connected to a voltage supply $V_{cc}$. Because the current sensed on line 106 is twice the base current (it is the combined current of $Q_3$ and $Q_4$) the areas of the transistors 114, 116 are fabricated in the ratio of 2:1 so that the current being replicated is halved since the base to emitter leakage current $I_b$ of only one transistor $Q_1$ is to be compensated for. Either current source 120, 122 may be included in current compensation circuit 100 in order to keep the current mirror 104 in an on condition even when none of the input stages in column 22 are receiving an input, so that bias voltage $V_b$ is still applied even when all input stages in a column are off.

Although specific features of the invention are shown in some drawings and not in others, this is for convenience only as each feature may be combined with any or all of the other features in accordance with the invention. The words "including, "comprising", "having", and "with" as used herein are to be interpreted broadly and comprehensively and are not limited to any physical interconnection. Moreover, any embodiments disclosed in the subject application are not to be taken as the only possible embodiments.

Other embodiments will occur to those skilled in the art and are within the following claims:

What is claimed is:

1. An input bias current reduction circuit for multiple input stages having a common input comprising:

a plurality of input stages each including a first input transistor with its base connected to the common input and a first current sensing transistor with its collector-emitter in series with the collector-emitter of the first input transistor and wherein the base current of said first input transistor and the base current of said first current sensing transistor are substantially equal; and a current compensation circuit having a first output terminal connected to said first input transistor of each input stage and said having a second output terminal connected to first current sensing transistor of each input stage for sensing the base current of said first current sensing transistor in each input stage and providing a replicated compensation current to said first input transistor in each input stage for maintaining constant reduced current loading of the input.

2. The input bias current reduction circuit of claim 1 in which each said input stage includes a second input transistor.

3. The input bias current reduction circuit of claim 1 in which said first current sensing transistor is cascode connected to said first input transistor.

4. The input bias current reduction circuit of claim 2 in which said first current sensing transistor is cascode connected to said first input transistor and there is a second current sensing transistor cascode connected to said second input transistor.

5. The input bias current reduction circuit of claim 2 in which said first and second input transistors are emitter coupled.

6. The input bias current reduction circuit of claim 2 in which said first and second input transistors form a differential amplifier.

7. The input bias current reduction circuit of claim 4 in which the bases of said first and second current sensing transistors are connected together.

8. The input bias current reduction circuit of claim 1 in which said transistors are bipolar.

9. The input bias current reduction circuit of claim 2 in which said transistors are bipolar.

10. The input bias current reduction circuit of claim 4 in which said transistors are bipolar.

11. The input bias current reduction circuit of claim 1 in which said current compensation circuit includes a current mirror.

12. The input bias current reduction circuit of claim 1 in which said current compensation circuit includes a current source.

13. The input bias current reduction circuit of claim 1 in which said in which said current compensation circuit is connected to a voltage source and provides a bias voltage to said current sensing transistor.

14. The input bias current reduction circuit of claim 1 in which said first input transistor is common emitter connected.

* * * * *